US005605492A

United States Patent [19]

Klingel

[11] Patent Number: 5,605,492

[45] Date of Patent: Feb. 25, 1997

[54] METHOD AND MACHINE TOOL FOR CUTTING WORKPIECES

[75] Inventor: Hans Klingel, Möglingen, Germany

[73] Assignee: Trumpf GmbH & Co., Ditzingen, Germany

[21] Appl. No.: 558,610

[22] Filed: Nov. 14, 1995

[30] Foreign Application Priority Data

Nov. 14, 1994 [DE] Germany ..... 44631.2

[51] Int. Cl.[6] ..... B24B 1/00

[52] U.S. Cl. ..... 451/40; 451/91; 451/102; 83/177

[58] Field of Search ..... 451/40, 38, 39, 451/99, 102, 91; 83/53, 177

[56] References Cited

U.S. PATENT DOCUMENTS

| | | | |
|---|---|---|---|
| 2,290,979 | 7/1942 | Luce | 451/40 |
| 2,387,193 | 10/1945 | Swenarton | 451/40 |
| 3,828,478 | 8/1974 | Bennis | 451/40 |
| 3,858,358 | 1/1975 | Stachowiak et al. | 451/40 |
| 3,972,150 | 8/1976 | Hart | 451/91 |

FOREIGN PATENT DOCUMENTS

| | | | |
|---|---|---|---|
| 0223433 | 5/1987 | European Pat. Off. . | |
| 961061A | 3/1957 | Germany | 451/102 |
| 8710495 | 11/1987 | Germany . | |
| 9103749 | 8/1991 | Germany . | |
| 1433660 | 10/1988 | U.S.S.R. | 83/177 |

*Primary Examiner*—Robert A. Rose
*Assistant Examiner*—George Nguyen
*Attorney, Agent, or Firm*—Pepe & Hazard

[57] ABSTRACT

A machine tool for cutting workpieces includes a cutting head with at least two cutting units each providing cutting beams directed at the workpiece so as to impinge thereon closely adjacent each other to cooperate in the cutting action. The machine tool includes a worktable to support the workpiece, and the workpiece and cutting head are relatively movable to provide a cutting line in the workpiece. At least one of the cutting units is movable relative to the other so that the angular relationship of the cutting beams may be varied, and the supply of the cutting medium is separately controlled for the cutting units. In one embodiment the cutting beams are high speed water jets which may contain abrasive and the cutting characteristics of the jets may be varied.

19 Claims, 2 Drawing Sheets

METHOD AND MACHINE TOOL FOR CUTTING WORKPIECES

BACKGROUND OF THE INVENTION

The present invention is directed to a process for cutting workpieces with a cutting beam such as a pressurized water jet, and, more particularly, to such a process wherein the cutting beam is directed at the workpiece to be processed and the workpiece and the cutting beam are moved relative to one another.

Presently available processes and machine tools for practicing the process are used, for example, to cut the workpiece into a number of parts, to cut it with a predetermined contour, and/or to cut predetermined contours into parts formed from the initial workpiece.

For this purpose, according to one known process using a known machine tool, a cutting beam in the form of a pressurized stream of water and the workpiece to be machined are moved in relation to one another crosswise to the cutting beam. In this way, the cutting beam makes a dividing cut of a predetermined length and in a predetermined cutting direction. To increase processing capacity, it is known to use machine tools that have at least two spaced cutting units connected to at least one source of a cutting beam each of which can emit a cutting beam when in operation, and in which the cutting units and the workpiece to be machined can be moved relative to one another in the cutting direction. Such tooling machines make it possible to produce several spaced parallel dividing cuts concurrently. Thus, for example, on tooling machines with two cutting units, two workpieces can be cut at the same time. However, the cutting speeds at which cuts with high-quality edges can be produced with the known process and the known machine tools need to be increased.

It is an object of the present invention to provide a novel process for cutting workpieces with a pair of beams, and a machine tool for carrying out this process, by means of which good-quality cut edges can be achieved at a high cutting speed.

SUMMARY OF THE INVENTION

It has now been found that the foregoing and related objects can be readily attained by providing a machine tool which includes at least two cutting beams which are directed at the workpiece to be machined in such a way that the beam axes intersect and/or the beam axes are adjacent one another along the cutting line. In developing the process of the invention, it was surprisingly found that the results that could be achieved with a cutting beam could be greatly improved and that the cutting speed could be increased without affecting the quality of the cut if at least a pair of cutting beams were used and the cutting beams were at an angle and/or intersected at the cutting line directly adjacent the workpiece to be machined. For a given cut quality, doubling the cutting speeds with this process compared to the conventional beam-cutting process is not a problem. A conceptual model for explaining the phenomenon observed assumes that, if two cutting beams disposed at an angle to one another are used, the one cutting beam supports the other and that in this way the cutting effect of at least one of the cutting beams is enhanced by preventing lateral breaking away of the cutting beam opposite the workpiece being machined because of the supporting effect. A "directly adjacent" arrangement of the cutting beams exists, in the sense of the present invention, if the distance between the point where the cutting beams meet on the cutting line is small, so that the enhancement of the cutting effect of at least one of the cutting beams is achieved.

In cases where the axes of the cutting beams in the invention run directly adjacent to one another on the cutting line, the axes can be aligned basically parallel to one another; but it is a special advantage in terms of cutting speed and the quality of the cutting edges if the cutting beams are aimed at the workpiece in such a way that the axes of the beams intersect under the cutting plane. Here, the cutting plane is defined by the tangential plane on the workpiece in the respective machining point.

One preferred embodiment of the process of the present invention is characterized by the fact that the cutting beams are aimed at the workpiece in such a way that the axes of the beams intersect below the cutting plane.

Superior machining results can be achieved by aiming the first cutting beam basically perpendicularly to the workpiece and the second cutting beam at an angle deviating from a right angle. But alternatively, two cutting beams can also be aimed at the workpiece at an angle deviating from a right angle.

To achieve a high cutting speed and good quality for the cut edges, it has proved useful for one cutting beam, if necessary preferably the perpendicular cutting beam, to be aimed at the workpiece in front of another cutting beam in the cutting direction. Preferably in cases where the axes of the cutting beams intersect below the workpiece, the cutting beam plane covered by the beam axes runs in the cutting direction.

Another variation of the process is characterized by the fact that two cutting beams are aimed at the workpiece in such a way that the beam axes intersect at an angle of less than 60°.

Basically, the advantages of the process of the present invention can be achieved with cutting beams provided by different cutting characteristics or media. In one preferred embodiment of the process of the present invention, cutting beams in the form of pressurized water jets, preferably containing abrasive media, are aimed at the workpiece. The pressurized water jets are aimed at the workpiece and have a pressure of 2800 to 3400 bar for this purpose.

One preferred version of the process of the present invention is characterized by the fact that only one cutting beam is aimed at the workpiece for the initial cutting and another cutting beam is aimed at it after the workpiece has been cut through by the first beam.

For this purpose, the one cutting beam and the workpiece are moved at a relatively slow relative speed for the initial cutting of the workpiece, and the relative speed is increased up to the the final cutting speed after the other cutting beam has been directed at and impinges upon the workpiece.

The aforementioned object of providing a machine tool for the practice of the process is solved by providing the cutting units on existing types of machine tools in which the workpiece and cutting head are relatively movable in operation at the same time so that there is relative movement along a common cutting line of the cutting units and workpiece. The cutting units should be arranged and aligned in such a way that the cutting beams they emit impinge upon the workpiece to be machined in the manner described above.

To permit a variation of the arrangement of the cutting beams to one another, one advantageous embodiment of the machine tool of the present invention provides at least one cutting unit which can pivot around a pivot axis basically parallel to the cutting plane together with another cutting unit cooperating with it, and the pivoted cutting unit can be fixed in the desired pivoted position. On this type of machine tool, the cutting beams can be directed generally parallel to one another or at changing angles to one another. The machine tool can then be adjusted for different requirements in use.

Another way of varying the path of the cutting beams to one another is provided by a version of the machine tool of the present invention in which the cutting units are arranged so they can move relative to one another basically parallel to the cutting plane, and preferably in the cutting direction.

When operating, the cutting beams are in a defined position in relation to the cutting direction. For example, when cutting with two parallel cutting beams or with two cutting beams intersecting at a point, the position of the cutting beams compared to the cutting direction is defined by the path of the cutting beam plane covered by the cutting beams as compared with the cutting direction. If the cutting direction is changed, the position of the cutting beams is maintained relative to the changed cutting direction. In both of these examples, the cutting beam plane must be altered relative to the workpiece for the purpose. Such a movement of the plane of the cutting beams is made possible in one preferred embodiment of the machine tool of the invention by the fact that at least one cutting unit can rotate relative to the workpiece around a pivot axis which is basically perpendicular to the cutting plane. A change in cutting direction and a rotating-pivoting movement associated with it by at least one cutting unit can be made both during the cutting operation and after an initial dividing cut has been made. In the first case, there is a curved dividing cut. In the second, another dividing cut can be made that extends outwardly from the finished cut and runs at an angle to it.

The machine tool is compact if the cutting units are on a common cutting head on the machine tool.

One preferred embodiment of the machine tool of the invention, is one in which pressurized water units are provided as the cutting units and there is a supply of abrasive for each pressurized water jet. In this manner, the cutting action of each of the cutting beams can be modified independently of the other.

Having the cutting units connected separately to the source of the cutting beam, as in the variation of the invention provided, also makes the machining flexible. Depending on the requirements in each specific case or depending on the phase of the cutting process, the cutting units can be operated together or individually.

One condition for automated workpiece machining is created by the fact that the cutting units may be controlled by control switches connected to the assigned source for the cutting beam.

According to the invention, machine tools whose cutting units can be connected to the assigned source of the cutting beam separately and/or by means of control switches are also used, for example, for converting from the type of variation of the process in the invention in which the workpiece being machined is cut with only one cutting beam and after that is worked on with two cutting beams.

Another preferred embodiment of a machine tool according to the invention has a speed control to control the relative speed of movement between the cutting units and the workpiece and the relative speed between the cutting units and the workpiece is controlled by means of the speed control which will provide a speed relative movement which depend on the number of cutting units that are providing cutting beams operating on the workpiece and/or the length of time the cutting units are functioning. Such a machine tool is also preferably intended for the two-phase cutting operation described above. In the initial cutting phase in which only one cutting beam is aimed at the workpiece, the speed control sets a relatively slow speed of relative movement between the cutting unit in operation and the workpiece. In this phase, the machine tool of the invention works by the conventional process where the dividing cut is made by means of a single machining beam.

After the initial cutting has been completed, the cutting beam of the second cutting unit disposed behind the cutting beam of the first cutting unit cuts the workpiece. Now, the cutting speed can be increased. Since the second cutting beam reaching the workpiece after the initial cut does not go fully into effect immediately upon reaching the workpiece, it is convenient if the cutting speed, hence the speed of relative movement between the cutting units and the workpiece, is not increased abruptly, but rather gradually, as soon as the second cutting unit has reached the workpiece. This is brought about by the speed control which gradually increases the speed of relative movement between the cutting units and the workpiece after the second cutting unit goes into effect. With corresponding control of the cutting units, the second cutting unit, the cutting beam of which is behind the first, can be connected to the source for the cutting beam only after the end of the initial cutting by the first cutting beam which precedes it in the cutting direction. In this cased during the initial cutting phase, a cutting beam is emitted by only one cutting unit.

DETAILED DESCRIPTION OF THE PREFERRED EMBODIMENT

Figure 1:
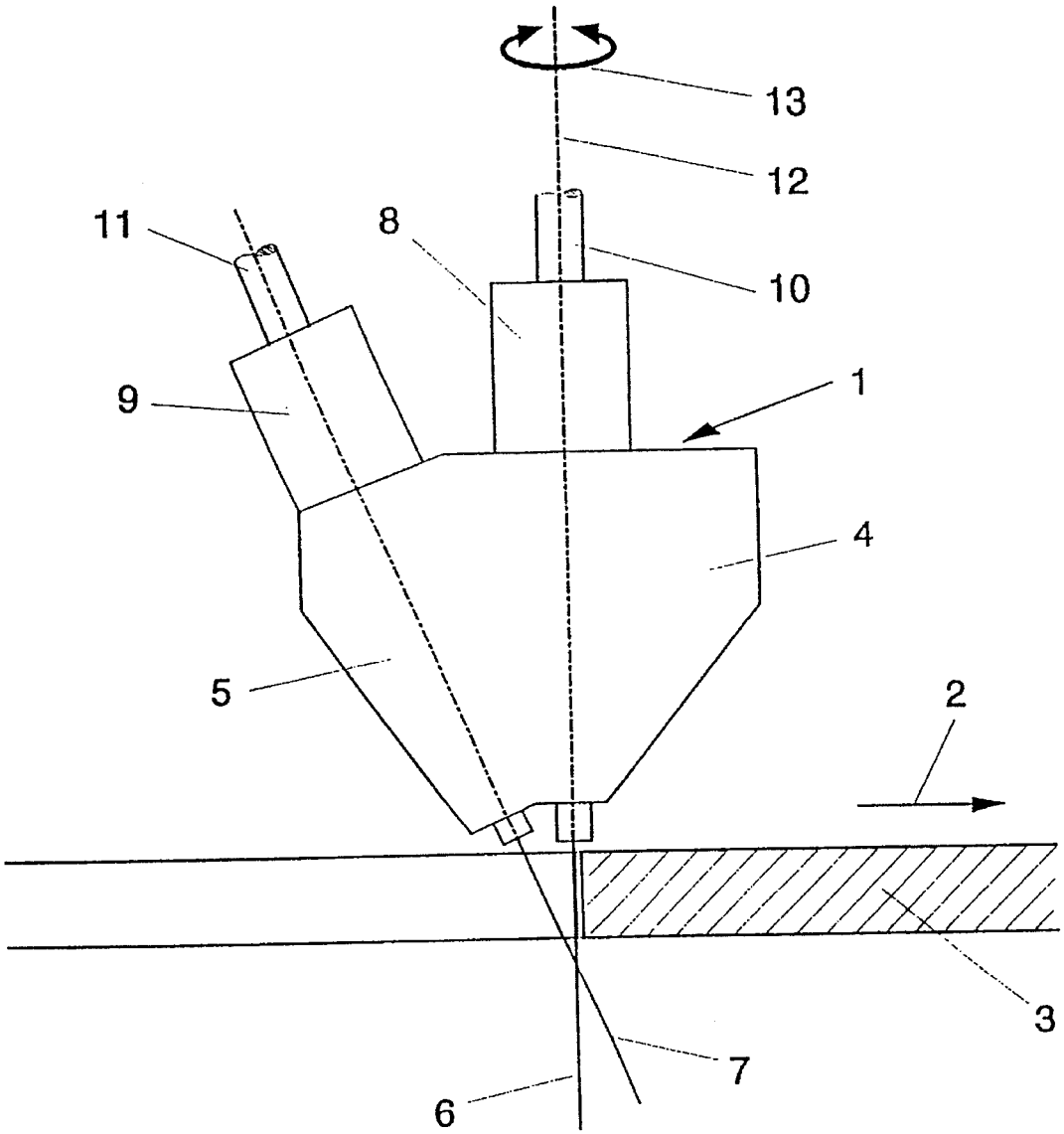
FIG. 1 shows a cutting head of a water-jet cutting machine embodying the present invention with a cutting head having two cutting units in one body.

FIG. 1 shows a cutting head 1 of a water-jet cutting machine which is movable in the direction of the arrow 2 relative to a stationary workpiece 3 in the form of a sheet-metal plate. The cutting head 1 is supported in the holder of a machine tool slide or carriage (not shown) overlying the sheet-metal plate 3. The machine tool carriage or slide can be moved along the length of sheet-metal plate 3. At the same time, the cutting head 1 can be controlled and moved in the longitudinal direction of the holder and thus transversely of the direction in which the machine tool slide moves. The cutting head 1 can, in this way, reach each point in the plane of the sheet-metal plate 3.

Built into the cutting head 1 are two cutting units 4, 5 which act on the sheet-metal plate 3 during the cutting operation by projecting cutting beams 6, 7 which in this embodiment are high-pressure water jets whose axes intersect under the cutting plane. The cutting unit 4 aims its cutting beam at a basically right angle to the surface of the sheet-metal plate 3. The cutting beam 7 emitted by the cutting unit 5 is disposed at an angle deviating from a right angle to the surface of the workpiece 3. The cutting beams 6, 7 and their axes cover a cutting beam plane that runs perpendicular to the sheet-metal plate 3.

The cutting units 4, 5 are connected to a high-pressure pump (not shown) by fittings 8, 9 and high-pressure lines 10,11 as schematically illustrated in FIG. 1. The whole cutting head 1 can be pivoted about a pivot axis 12 extending in the direction of the axis of the cutting beam 6 as indicated by the direction of the arrow 13.

Now if a dividing cut is to be made in the sheet-metal plate 3 by means of the cutting head 1, the cutting units 4, 5 are connected to the high-pressure pump. The cutting beam 6 emitted by the cutting unit 4 is ahead of the cutting beam 7 emitted by the cutting unit 5 in the cutting direction, i.e., in the direction of arrow 2. The cutting beam 6 emitted by the cutting unit 4 penetrates the sheet-metal plate 3 and produces the initial cut as the cutting head 1 is moved in the cutting direction symbolized by the arrow 2. As soon as the initial cut has been made, the cutting beam 7 emitted by the cutting unit 5 also impinges upon the sheet-metal plate 3. After the cutting beam 7 has reached the sheet-metal plate 3, the speed of the cutting head 1 starting from a relatively low initial cutting speed is increased to the final cutting speed. Also during the subsequent cutting process, the cutting beam 6 emitted by the cutting unit 4 is directed at the sheet-metal plate 3 in front of the cutting beam 7 in the cutting direction 2. The cutting beam plane covered by the cutting beams 6, 7 runs in the cutting direction. The pressure of the cutting jet streams 6, 7 is around 3000 bar.

To change the cutting direction, the cutting head 1 is pivoted about the pivot axis 12. This way, the cutting machine shown can also make curved dividing cuts and straight cuts at an angle to one another.

Figure 2:
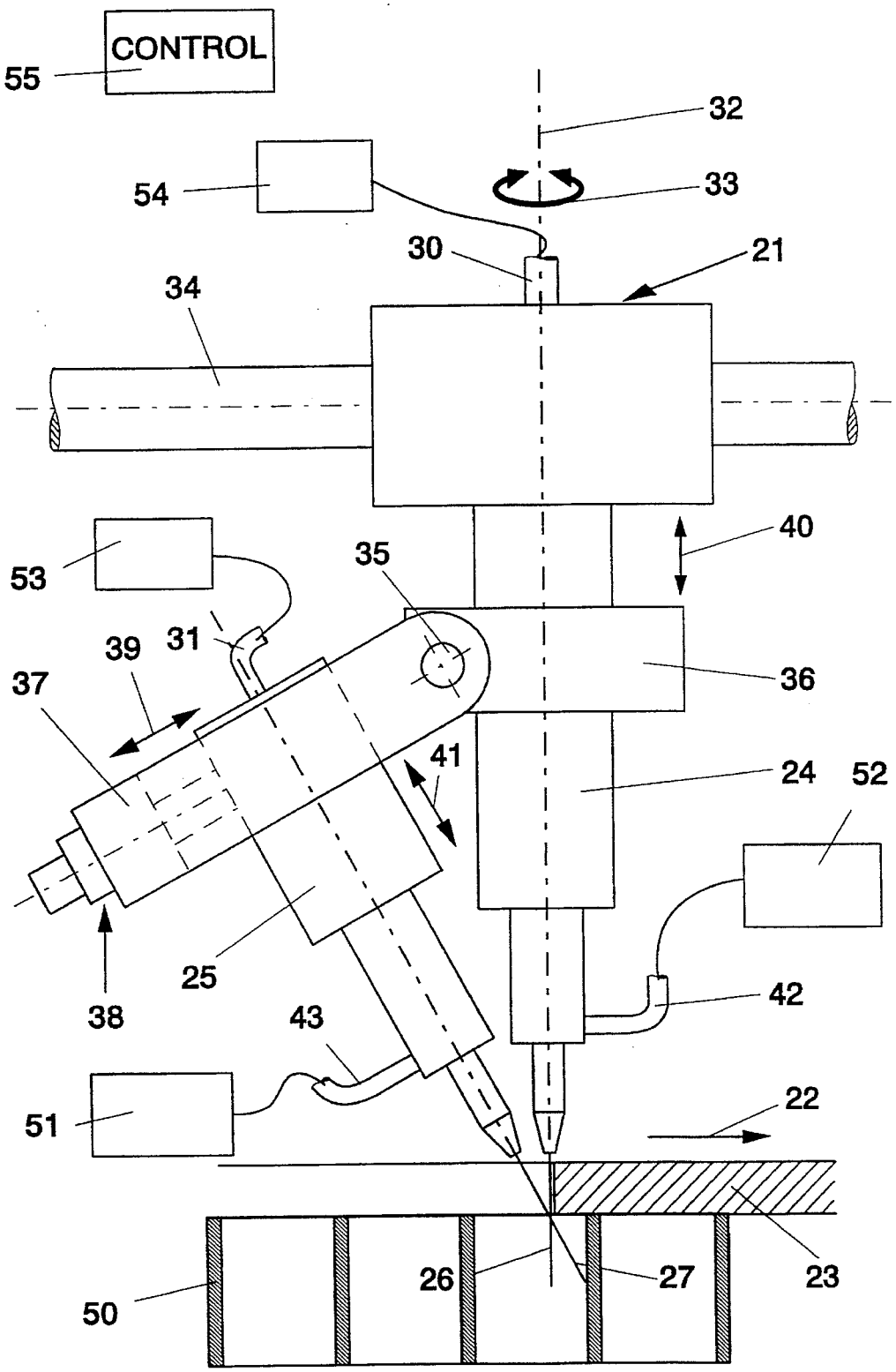
FIG. 2 shows an alternate embodiment of a cutting head of a water-jet cutting machine with a cutting head having separate cutting units so that one may be moved relative to the other.

The cutting machine partially shown in FIG. 2 has a cutting head 21 with two separate cutting units 24, 25. The cutting head 21 is motor-driven and can move along the holder or rail 34 of a machine tool slide in the direction of the arrow 22 symbolizing the cutting direction, over the workpiece 23 in the form of a sheet-metal plate which is supported on the fragmentarily illustrated grid-like work-table 50.

The cutting units 24, 25 are connected to one another so that the unit 25 can pivot about an axis 35 running basically parallel to the plane of the sheet-metal plate 23, i.e., to the cutting plane. Clamp-like holders 36,37 which surround the cutting units 24, 25 are used to make the pivotal connection therebetween. The cutting unit 25 inside its holder 37 can be adjusted in the direction of the double arrow 39 by means of a spindle drive 38. The cutting unit 25 can also be moved in the direction of the double arrow 41. The holder 36, which surrounds the cutting unit 24, can be moved in the direction of a double arrow 40 basically perpendicularly to the plane of the sheet-metal plate 23. The whole cutting head 21 can be pivoted by a motor (not shown) about the pivot axis 32 in the direction of the double arrow 33.

When in operation, the cutting units 24, 25 direct the cutting beams 26, 27, shown in FIG. 2, at the surface of the sheet-metal plate 23. The cutting beam 26 of the cutting unit 24 basically extends perpendicularly to the surface of the workpiece 23 and the cutting beam 27 of the cutting unit 25 extends at an angle deviating from a right angle with the workpiece surface. The two cutting beams 26, 27 intersect in the cutting plane and cover a cutting beam plane running in the direction of the arrow 22 in the cutting direction.

The cutting beams 26, 27 are produced by means of pressurized water for cutting which is fed to the cutting units 24, 25 through high-pressure lines 30, 31 from the pumps 53, 54 to produce jets which impinge on the workpiece 23. To vary the cutting effect, the cutting beams 26, 27 can include in the jets abrasives which are fed through lines 42, 43. Each of the cutting beams 26, 27 has its own abrasive supply 51, 52. In this manner, the characteristics of the cutting beams 26,27 can be adjusted to the requirements of the individual case.

The capabilities for adjusting the cutting units 24, 25 previously described are also used to adjust to different working conditions. Thus, by pivoting the cutting unit beams 26, 27, the cutting axes can be changed. By moving the cutting unit 25 in the direction of the double arrow 39, the position of the point of intersection of the cutting beams 26, 27 in relation to the plane of the sheet-metal plate 23 can be varied. One way of positioning the cutting unit 25 relative to the surface of the sheet-metal plate 23 is offered by the adjustability of the cutting unit 25 in the direction of the double arrow 41. An adjustment of the cutting unit 25 in the direction of the double arrow 39 involves an adjustment in the cutting unit 25 in the direction of the double arrow 41, if the position of the point of intersection of the cutting beams 26, 27 and their axes is changed in relation to the sheet-metal plate 23, but the distance between where the beam comes out of the cutting unit 25 and the sheet-metal plate 23 should remain the same.

The machine tool in FIG. 2 basically works the same as the embodiment described above and shown in FIG. 1. Both machine tools are also suitable for machining workpieces to provide curved cuts.

The control 55 allows the operator to control the various valves, switches and motors, either manually or by computer program.

Having thus described the invention, what is claimed is:

1. In a process for cutting workpieces by means of a cutting beam, the steps comprising:

(a) directing a first cutting beam at a workpiece to be machined;

(b) directing at least one other cutting beam at said workpiece so that the axes of said first and said other cutting beams impinge on the surface of said workpiece adjacent each other to cooperate in effecting cutting of said workpiece; and (c) moving said workpiece and said cutting beams relative to one another to cut said workpiece along a cutting line, said cutting beams intersecting at a point spaced from said surface of said workpiece in the direction opposite from the origin of said cutting beams.

2. The process according to claim 1 wherein said cutting beams are directed at said workpiece so that the beam axes intersect at a point spaced outwardly of the other surface of said workpiece.

3. The process according to claim 1 wherein said cutting beams are directed at said workpiece so that the beam axes intersect at a point in said workpiece under the cutting plane.

4. The process according to claim 1 wherein said first cutting beam is directed at said workpiece along an axis perpendicular thereto and said other cutting beam is directed at said workpiece at an angle deviating from a right angle.

5. The process according to claim 1 wherein said first and other cutting beams are both directed at said workpiece at angles deviating from a right angle.

6. The process according to claim 4 wherein said one cutting beam impinges on said workpiece ahead of said other cutting beam along said cutting line in the cutting direction.

7. The process according to claim 1 wherein the axes of said cutting beams intersect at an angle of less than 60°.

8. The process according to claim 1 wherein said cutting beams are pressurized water jets.

9. The process according to claim 8 wherein said pressurized water jets are under a pressure of 2800 to 3400 bar.

10. The process according to claim 8 wherein said water jets contain abrasive.

11. The process according to claim 1 wherein initially only said first cutting beam is directed at said workpiece to begin cutting of said workpiece and, after it has initially cut said workpiece, said other cutting beam is then directed at said workpiece.

12. The process according to claim 11 wherein the initial cutting of said workpiece is effected at a first speed of relative movement and the speed of relative movement is thereafter increased to a predetermined speed when said other beam is directed at said workpiece.

13. In a process for cutting workpieces by means of a cutting beam, the steps comprising:

(a) directing a first cutting beam at a workpiece to be machined;

(b) directing at least one other cutting beam at said workpiece so that the axes of said first and said other cutting beams impinge on said workpiece adjacent each other to cooperate in effecting cutting of said workpiece; and (c) moving said workpiece and said cutting beams relative to one another to cut said workpiece along a cutting line, said first cutting beam impinging on said workpiece ahead of said other cutting beam in the cutting direction along said cutting line, one of said cutting beams being directed at said workpiece along an axis perpendicular thereto and the other of said cutting beams being directed at said workpiece along an axis at an angle deviating from a right angle.

14. The process according to claim 13 wherein said cutting beams intersect at a point spaced from said surface of said workpiece in the direction opposite from the origin of said cutting beams.

15. The process according to claim 13 wherein said cutting beams are pressurized water jets containing abrasive.

16. In a process for cutting workpieces by means of a cutting beam, the steps comprising:

(a) directing a first cutting beam at a workpiece to be machined;

(b) directing at least one other cutting beam at said workpiece so that the axes of said one and said other cutting beams impinge on said workpiece adjacent each other to cooperate in effecting cutting of said workpiece; and (c) moving said workpiece and said cutting beams relative to one another to cut said workpiece along a cutting line, initially only said first cutting beam being directed at said workpiece to begin cutting of said workpiece and, after it has initially cut said workpiece, said other cutting beam then being directed at said workpiece.

17. The process according to claim 16 wherein the initial cutting of said workpiece is effected at a first speed of relative movement and the speed of relative movement is thereafter increased to a predetermined speed when said other beam is directed at said workpiece.

18. The process according to claim 16 wherein said cutting beams intersect at a point spaced from said surface of said workpiece in the direction opposite from the origin of said cutting beams.

19. The process according to claim 16 wherein said cutting beams are pressurized water jets containing abrasive.

* * * * *